US008074814B2

(12) United States Patent
Morris et al.

(10) Patent No.: US 8,074,814 B2
(45) Date of Patent: Dec. 13, 2011

(54) WALL-MOUNTED CAROUSEL FOR ELECTRIC TOOTHBRUSHES

(76) Inventors: James Bradford Morris, Catonsville, MD (US); Lisa Beatrice Mears, Catonsville, MD (US)

( * ) Notice: Subject to any disclaimer, the term of this patent is extended or adjusted under 35 U.S.C. 154(b) by 177 days.

(21) Appl. No.: 12/217,617

(22) Filed: Jul. 7, 2008

(65) Prior Publication Data

US 2010/0326932 A9 Dec. 30, 2010

Related U.S. Application Data

(63) Continuation-in-part of application No. 11/546,797, filed on Oct. 12, 2006, now Pat. No. 7,395,939.

(60) Provisional application No. 60/725,635, filed on Oct. 13, 2005.

(51) Int. Cl.
*A47B 81/02* (2006.01)

(52) U.S. Cl. ..... 211/65; 206/362.1; 211/70; 211/119.9

(58) Field of Classification Search ..... 211/60.1, 211/69.1, 71.01, 13.1, 199, 70, 95, 119.9, 211/70.6, 65, 66, 163, 165, 77, 78, 115; 206/361, 206/362, 362.1; 248/110, 349.1
See application file for complete search history.

(56) References Cited

U.S. PATENT DOCUMENTS

| | | | | | |
|---|---|---|---|---|---|
| 712,824 | A * | 11/1902 | Masland | 211/65 |
| 1,903,410 | A * | 4/1933 | Cecil | 211/70.3 |
| 2,902,145 | A * | 9/1959 | Wagner | 206/362.1 |
| 2,956,851 | A * | 10/1960 | Merendino | 312/207 |
| 3,108,695 | A * | 10/1963 | Morris | 211/65 |
| 3,794,181 | A * | 2/1974 | Canham | 211/65 |
| 4,534,471 | A * | 8/1985 | Zahn et al. | 211/39 |
| 4,875,593 | A * | 10/1989 | Trimble | 211/95 |
| 5,074,421 | A * | 12/1991 | Coulter | 211/78 |
| 5,769,245 | A * | 6/1998 | Butler | 211/65 |
| 5,772,050 | A * | 6/1998 | Shih | 211/39 |
| 6,308,838 | B1 * | 10/2001 | Endean | 211/37 |
| D502,623 | S * | 3/2005 | Minard et al. | D6/534 |
| 6,935,515 | B1 * | 8/2005 | Sookoo | 211/65 |
| D513,948 | S * | 1/2006 | Martin | D7/707 |
| 7,083,070 | B2 * | 8/2006 | McGuyer | 222/144 |
| 7,225,633 | B2 * | 6/2007 | DeMars | 62/457.6 |
| 7,395,939 | B2 * | 7/2008 | Morris et al. | 211/65 |
| 2003/0015486 | A1 * | 1/2003 | Chen | 211/70 |
| 2003/0192840 | A1 * | 10/2003 | Hoyle et al. | 211/85.2 |

(Continued)

*Primary Examiner* — Darnell Jayne
*Assistant Examiner* — Devin Barnett
(74) *Attorney, Agent, or Firm* — Ober, Kaler, Grimes & Shriver; Royal W. Craig

(57) ABSTRACT

The present invention is a wall-mounted toothbrush carousel that stores one or more electric and/or standard toothbrushes in a convenient rotary dispenser. The rotary dispenser comprises a top-mounted knob atop a clover-shaped disc, the disc being connected to a stem in a spindle-type manner. The bottom of the stem is connected to a concave base. In some embodiments, the concavity of the base collects and contains runoff. In other embodiments, the base may be defined by one or more drain holes to allow drainage of the residue. The stem offsets the disc from the base. The disc is four-leaf-clover-shaped and defined by alternate apertures (for holding standard and electric toothbrushes) and U-shaped recesses for holding electric toothbrushes. The spindle-type holder revolves around and holds one or more electric toothbrushes as well as standard toothbrushes in queued positions. The rotary dispenser may be seated in a freestanding base unit (various sizes and shapes) having a vertical notch for access to the queued toothbrushes, or may be seated on a wall mounting as desired.

4 Claims, 9 Drawing Sheets

U.S. PATENT DOCUMENTS

2004/0218402 A1* 11/2004 Jao ..... 362/555
2007/0084810 A1* 4/2007 Morris et al. ..... 211/65
2007/0267368 A1* 11/2007 Pappas ..... 211/65
2008/0055906 A1* 3/2008 Lin ..... 362/253
2008/0290054 A1* 11/2008 Cass et al. ..... 211/70

* cited by examiner

SECTION A-A

SECTION B-B

WALL-MOUNTED CAROUSEL FOR ELECTRIC TOOTHBRUSHES

CROSS-REFERENCE TO RELATED APPLICATIONS

The present application is a continuation-in-part of U.S. application Ser. No. 11/546,797, filed 12 Oct. 2006, now U.S. Pat. No. 7,395,939 issued Jul. 8, 2008, which in turn derives priority from U.S. provisional application No. 60/725,635 filed 13 Oct. 2005.

BACKGROUND OF THE INVENTION

1. Field of the Invention

The present invention relates to bathroom storage accessories, and more particularly, to a storage carousel with wall mount for multiple electric toothbrushes.

2. Description of the Background

The ordinary toothbrush has become a specialty item and there are now many different toothbrush configurations and designs geared toward different markets, such as children, senior citizens, etc. Conventional toothbrush holders, prevalent in many homes, are not able to accommodate the wide variety of new and changing designs.

Traditional toothbrush holders are either standalone (on the sink) or wall mounted. They include a container/base topped by a cover that has a plurality of apertures for insertion of the toothbrushes.

There are prior art holders that try to accommodate different toothbrushes, such as Menard U.S. Pat. No. 5,609,259 (1995). With this wall mount holder the toothbrush is directed into an L-shaped slot. This design holds a variety of toothbrushes securely. However, it is strictly for manual toothbrushes.

The first electric toothbrush was introduced by Squibb Pharmaceutical at the centennial of the American Dental Association in 1960. This was a rotation-type electric toothbrush, and despite studies that showed it marginally outperformed manual brushing, removing around 7% more plaque and leading to 17% less gum disease than manual brushes, there was a limited market due to the high cost.

A new generation of electric toothbrush, the sonic toothbrush, claims to have even greater cleaning potential. One popular brand of sonic toothbrush is the Sonicare manufactured by Philips. The Sonic Toothbrush was invented in 1983, and the brush head is capable of creating in excess of 30,000 brush strokes per minute. At this intense speed that the bristles vibrate, a secondary cleaning action occurs. It is able to provide energy to the liquids that surround the teeth.

Lately, the cost of these toothbrushes as well as their consumer appeal has increased dramatically. The major manufacturers are now able to produce an array of electric toothbrush models having differentiated housings, some for men, some for women, others having molded character housings for children, etc. All generally have an elongated neck leading to a head, and a pronounced body for containment of batteries or battery packs. None of the conventional toothbrush holders are adapted for the general footprint of electric toothbrushes, let alone the myriad variations, or a combination of electric and conventional toothbrush holders as described above. It is now common for a typical family to have seven or eight electric toothbrushes cluttering up their bathroom. After usage, electric toothbrushes are typically left upright or laid flat on the countertop surface. Such makeshift storage only adds to the veritable mountain of clutter that already occupies most limited bathroom counter space in most households, along with other items such as hair brushes, deodorants, toiletries and cosmetics. Moreover, the makeshift storage of electric toothbrushes usually results in water and toothpaste residue leaching out around the sink area. This leaves an unsanitary mess. The hodge podge of articles increases the risk of cross contamination between these items.

What is needed is a carousel holder that will accommodate any one or more from among the current variety of electric toothbrushes, with ample ability to accommodate the ever changing and evolving designs of electric toothbrushes, plus the capacity to store standard manual toothbrushes, and to hold them all in a secure, sanitary and easily accessible manner that is easy to use and keep clean. Such a holder would accommodate a plurality of electric as well as manual toothbrushes, would allow them to drain and runoff the drainage, thereby preventing toothpaste or water residue on counter tops.

SUMMARY OF THE INVENTION

It is therefore an object of the present invention to provide a convenient storage solution comprising a wall-mounted carousel for securely storing any one or more electric toothbrushes alone or in combination with standard manual toothbrushes.

It is a more specific object to provide a toothbrush storage solution that incorporates a spindle-type holder that revolves around and holds one or more electric toothbrushes plus standard toothbrushes in a convenient, easily reachable, queued position. The wall-mounted electric toothbrush carousel that offers consumers a clean, readily accessible and conveniently placed storage solution for one or more bulky electric toothbrushes, with extra capacity for an array of conventional manual toothbrushes, facilitating more sanitary and convenient storage solution for family of adults as well as children.

It is still another object to provide an illuminated toothbrush storage carousel for nighttime location and aesthetic effect.

Still another object is to provide a universal electric carousel that is simple, light in weight, pleasant to use, relatively inexpensive to produce, and fully scalable (i.e. it may vary in size to fit various toothbrush dimensions).

In accordance with the foregoing objects, the present invention is a universal carousel for storing any one or more electric toothbrushes, with inherent capacity for one or more electric toothbrushes alone or in combination with a plurality of standard toothbrushes. Indeed electric toothbrushes feature a much wider base than the standard toothbrushes in order to accommodate internal batteries and inner mechanics, and this carousel is designed to hold both electric and standard toothbrushes. The electric toothbrush carousel includes a rotary dispenser that is seated inside a walled base unit. The rotary dispenser comprises a top-mounted knob atop a clover-shaped disc, the disc being connected to a stem in a spindle-type manner. The bottom of the stem is connected to a base, the stem offsetting the disc from the base. The base is concave to collect reside, and may be defined by one or more holes for drainage of the residue. The disc is four-leaf-clover-shaped and defined by alternate apertures (for holding standard and electric toothbrushes) and U-shaped recesses for holding electric toothbrushes. The spindle-type holder revolves around and holds the electric toothbrushes as well as standard toothbrushes in queued positions. The rotary dispenser may be seated in a freestanding base unit (various sizes and shapes) having a vertical notch for access to the queued toothbrushes, or may be freestanding on a counter, or seated on a wall mounting as desired.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

The present invention is a universal wall-mounted electric toothbrush carousel 1 that stores one or more electric toothbrushes of any size, alone or in combination with an array of standard toothbrushes, in a convenient rotary queue dispenser 2. The invention is herein described in the context of a universal electric toothbrush carousel 1 adapted for storing one-to-eight electric toothbrushes plus a variety of standard manual toothbrushes, although one skilled in the art should understand that the illustrated toothbrush carousel 1 may be scaled to accommodate as many as sixteen electric toothbrushes without departing from the scope and spirit of the invention. The toothbrush storage carousel 1 incorporates a unique spindle-type rotary dispenser 2 that revolves upon a wall-mount base 4 to hold and dispense electric toothbrushes as well as standard toothbrushes in queued positions.

Figure 1:
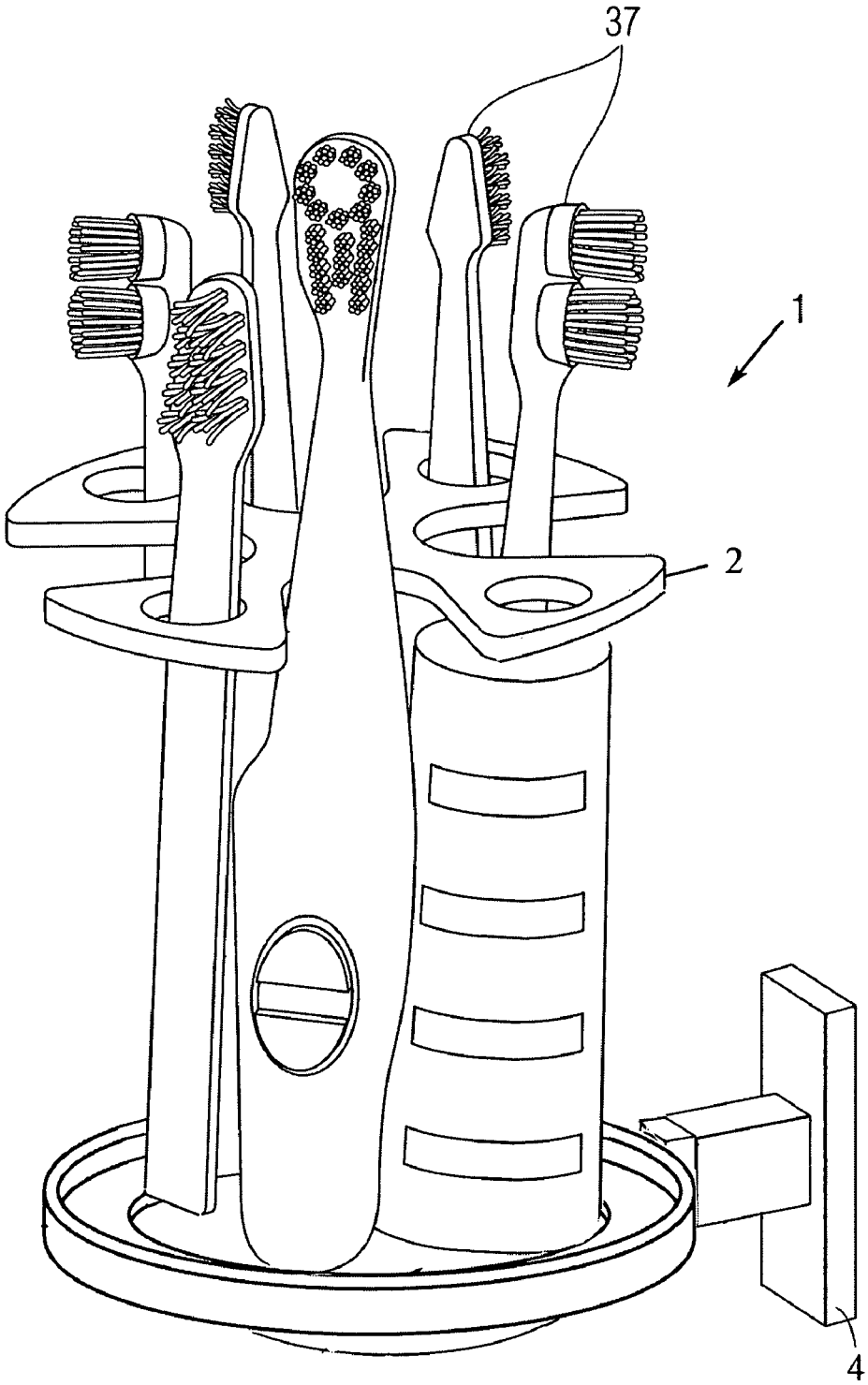
FIGS. 1 and 2 are perspective and exploded views, respectively of the preferred embodiment of the wall-mounted carousel 1.
Figure 2:
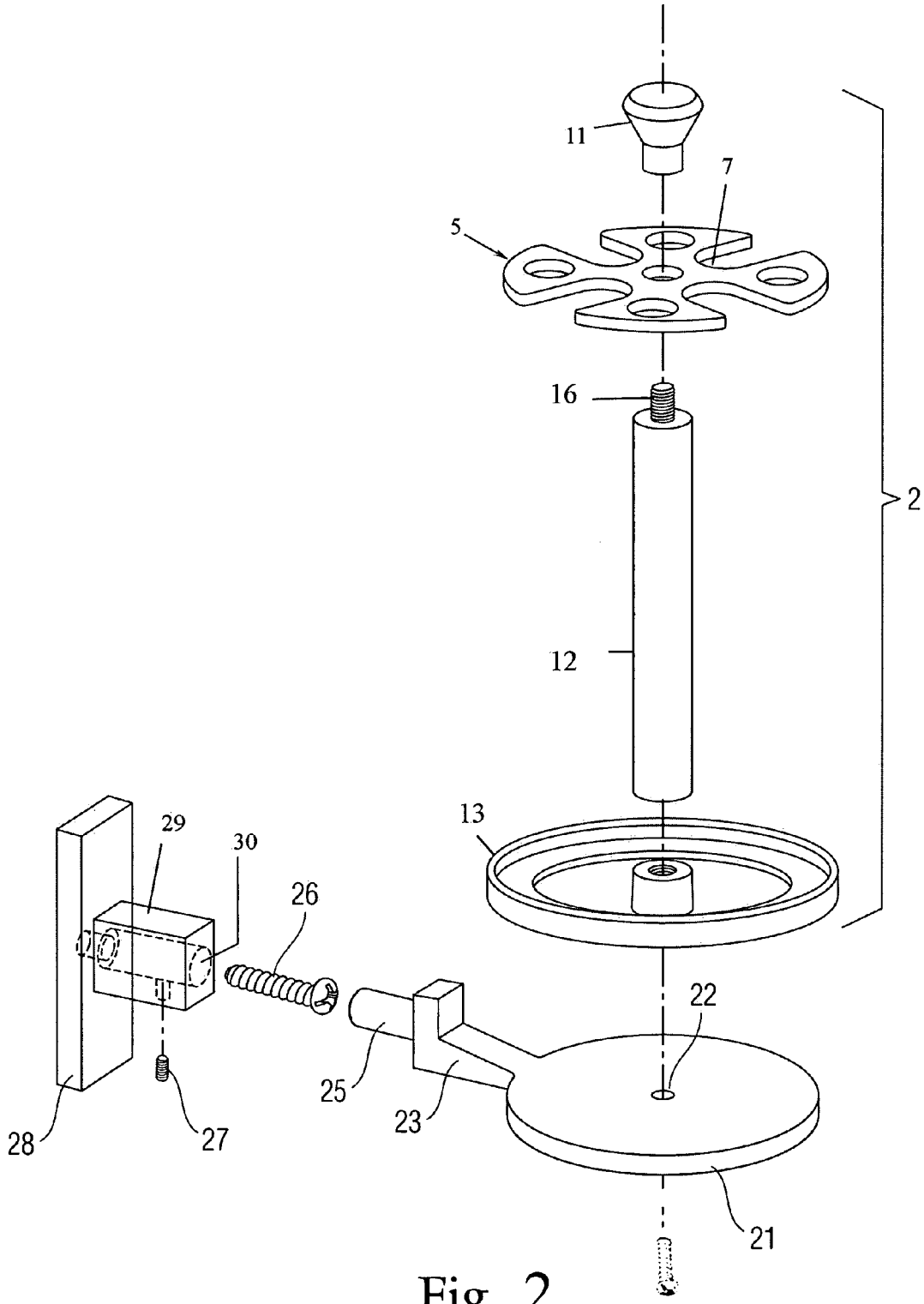

FIGS. 1 and 2 are perspective and exploded views, respectively of the preferred embodiment of the carousel 1, including rotary dispenser 2 seated upon the wall-mounted base unit 4. The base unit 4 comprises a vertical mounting bracket 28 that may be adhered, screwed, attached by hook-and-loop fabric, or otherwise secured to a wall. The vertical mounting bracket 28 is formed with a horizontal block 29 further defined by an axial through-bore 30 to allow screw 26-securement of the vertical mounting bracket 28 into the wall. A platform 21 is supported by a bracket 23, which is formed with an extending cylindrical finger 25. The L-shaped bracket 23 is integrally attached to the platform 21 and protrudes rearwardly to the finger 25, which is inserted into the vertical mounting bracket 28 secured to a wall. In addition, vertical mounting bracket 28 is also defined by a vertical threaded bore to allow a set screw 27 to be inserted up through horizontal block 29 to engage the finger 25 of extension 23 for securement to the wall mounting bracket 28 and to prevent withdrawal.

The entire rotary dispenser 2 sits atop the platform 21 and rotates by manual turning to queue a brush 37 for convenient access.

Figure 4:
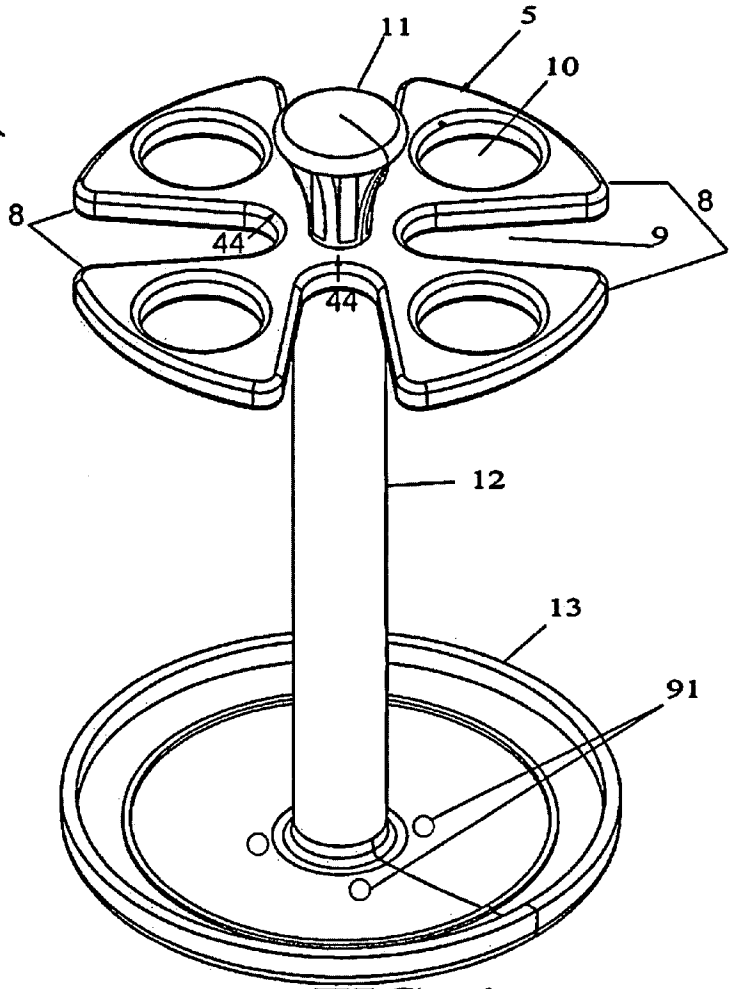
FIGS. 3 and 4 are side, and front assembled views, respectively of the rotary dispenser 2.
Figure 3:
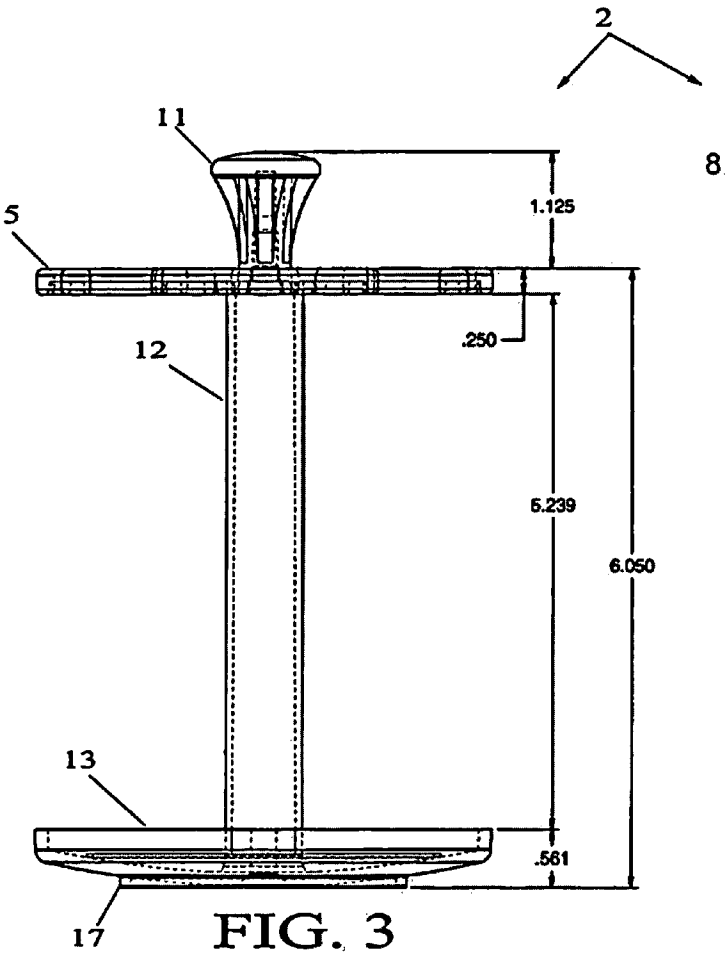

FIGS. 3 and 4 are side, and front assembled views, respectively of the rotary dispenser 2. With collective reference to FIGS. 1-4, the rotary dispenser 2 comprises a clover-shaped (generally cylindrical slotted) disc 5 mounted atop a stem 12, which protrudes upwardly from an upwardly-concave circular base 13. The clover disc 5 has a centrally-defined aperture 7 for insertion of a threaded post 16 that protrudes upward from stem 12. Post 16 passes through clover disc 5 and an ornate knob 11 is mounted there atop to compress the clover disc 5 between knob 11 and stem 12.

The clover disc 5 is preferably a molded acrylic or other plastic component, here formed with four separated leaves 8 to give the appearance of a four-leaf clover. Again, the carousel 1 may be scaled in diameter, and scaled in number of leaves to accommodate more (as many as sixteen electric toothbrushes with sixteen leaves) without departing from the scope and spirit of the invention.

In use of the carousel 1, the pre-assembled rotary dispenser 2 is inserted onto the wall-mounted base unit 4. A brush 37 is queued by turning the knob 11 which rotates the entire rotary dispenser 2. The user can easily lift the brush 37 out for use, or reinsert the brush for storage. The spindle-type rotary dispenser 2 of FIG. 3 revolves around and holds one or more electric toothbrushes (in U-shaped notches 9) plus four standard or electric toothbrushes (in apertures 10) in a convenient, easily reachable, queued position. The spindle-type holder 2 was designed especially to accommodate the wide base of the electric toothbrush which houses internal batteries and internal mechanics.

Figure 6:
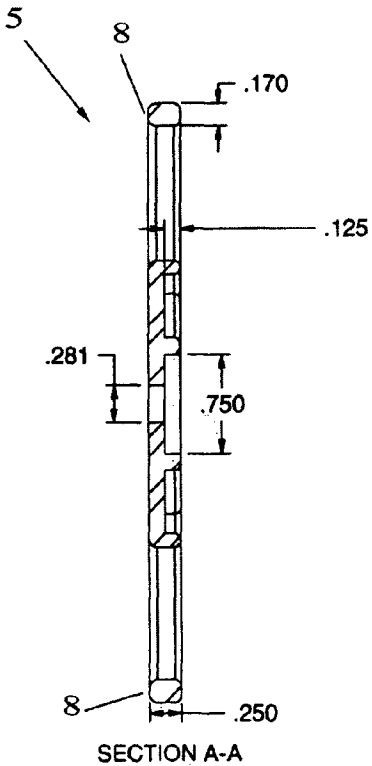
FIGS. 5-6 are top and cross-sectional views of the clover disc 5 with exemplary dimensions.
Figure 5:
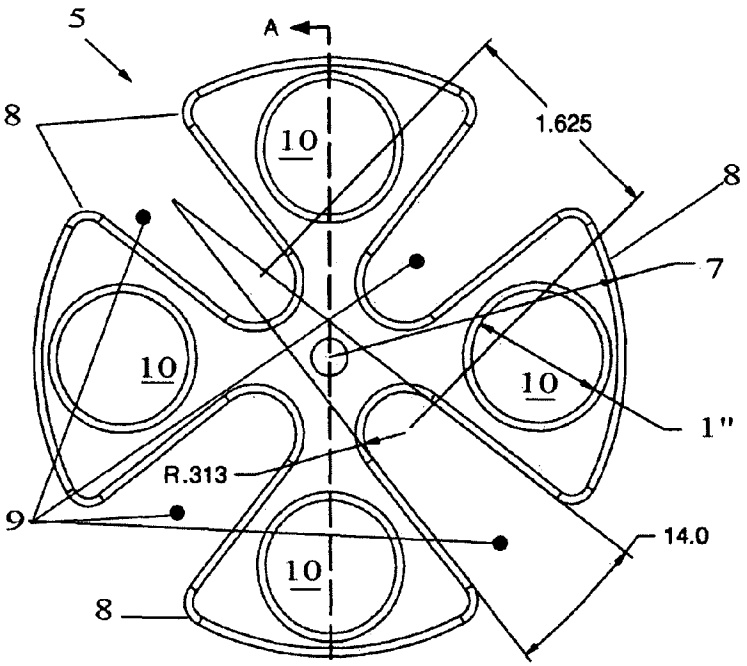

FIGS. 5-6 are top and cross-sectional views of the clover disc 5 with exemplary dimensions. The clover disc 5 is approximately 0.250 inches thick with a two-tier central aperture 7 having a small diameter on one (top) side of approximately 0.281 inches and a larger diameter on the other (bottom) side of approximately 0.750 inches. Four leaves 8 of clover disc 5 protrude from a central section, and the leaves 8 are each separated by a U-shaped recess 9 defined between flanking leaves 8 of the clover disc 5 (four recesses 9 total, though disc 5 may be scaled in diameter to accommodate more recesses 9 and number of leaves to store more (as many as sixteen electric toothbrushes with sixteen leaves) without departing from the scope and spirit of the invention). The radius of curvature at the trough 44 of each U-shaped recess 9 is on the order of approximately 0.313 inches, and the edges of the recesses 9 flare outward at 14 degrees to an opening from the clover disk 5 of about 1-1.2 inches. Each of the leaves 8 of clover disc 5 is formed with a centrally defined aperture 10 to receive the neck of a manual (or electric) toothbrush 37. The diameter of each aperture 10 in the clover disc 5 is approximately one inch. The radius of the clover disc 5 is 2.250 inches. The length measured from the center of the aperture 7 to the center of each aperture 10 is 1.580 inches.

Figure 7:
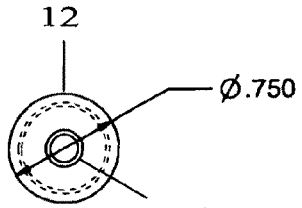
FIGS. 7-9 are cut-away, cross-sectional, and top views, respectively of the stem 12.
Figure 8:
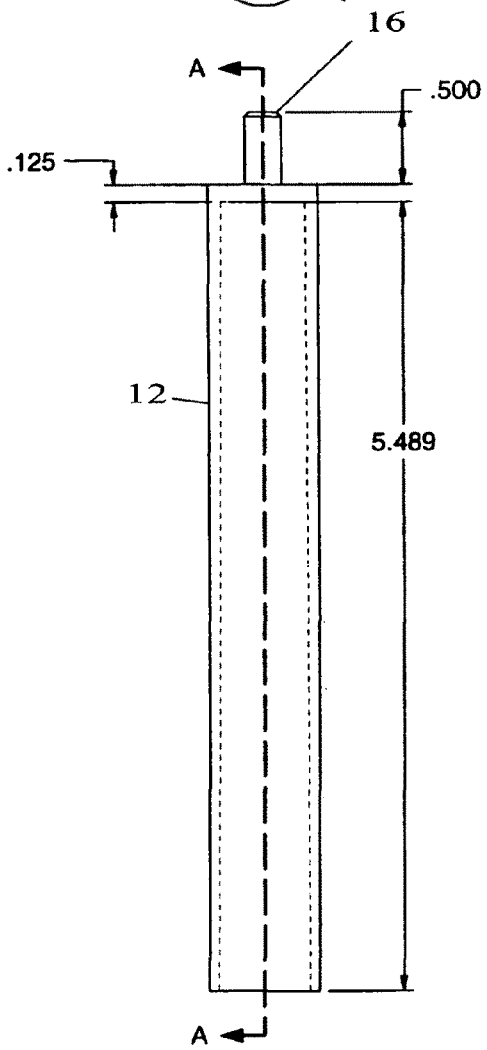
Figure 9:
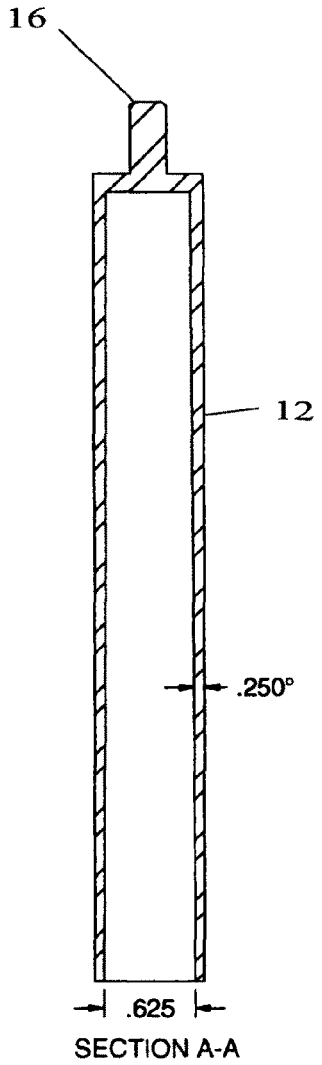

FIGS. 7-9 are cut-away, cross-sectional, and top views, respectively of the stem 12. The hollow stem 12 has a diameter of 0.750 inches, and a length of 5.489 inches. The length of the threaded stem 16 is 0.500 inches.

Figure 11:
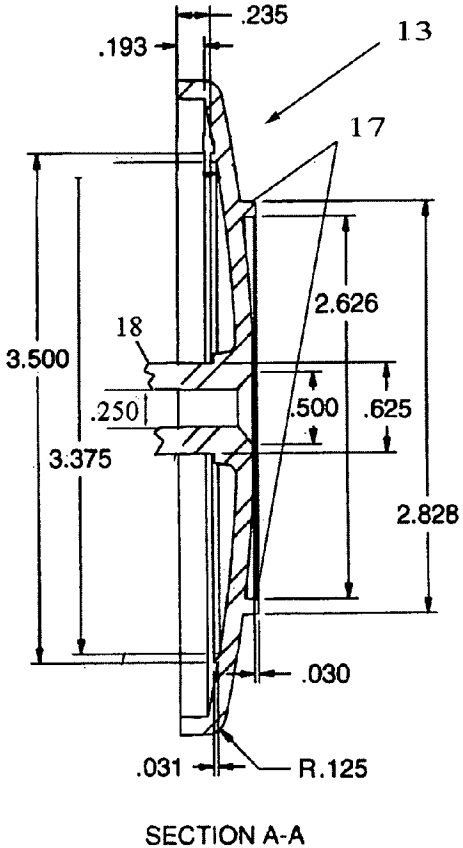
FIGS. 10-11 are top and side cross-sectional views, respectively of the concave base 13.
Figure 10:
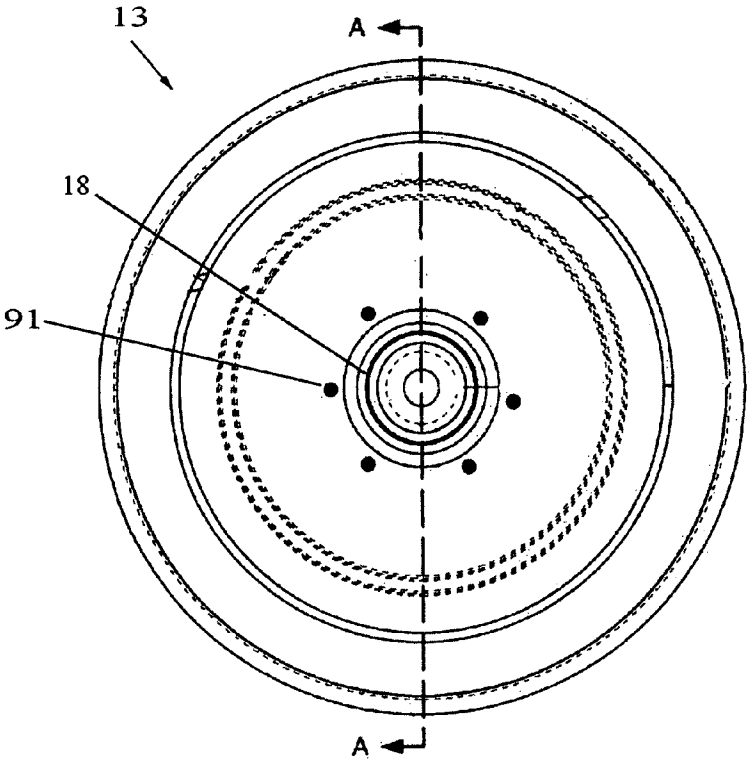

FIGS. 10-11 are top and side cross-sectional views, respectively of the concave base 13. The outer diameter of the base 13 is 4.500 inches. The height of the base 13 is 0.561 inches. The bottom surface of the base 13, while concave upward, is defined by a downwardly protruding annular lip 17 to seat the base against the closed bottom 36 of base unit 4 and yet facilitate rotation thereon. As seen in FIG. 2, the outer diameter of the base 13 generally conforms to but is slightly smaller than the base 36 of the base unit 4 to allow free rotation therein. As seen in FIG. 10, the floor of the base 13 proximate the neck 18 may, in some embodiments, be defined by one or more drain holes 91 to allow drainage from the concave hollow of the base 36 into the base unit 4 for improved sanitation and easy cleaning. In embodiments lacking drain holes 91 the concave floor of the base 13 itself serves to capture and collect residue.

Figure 12:
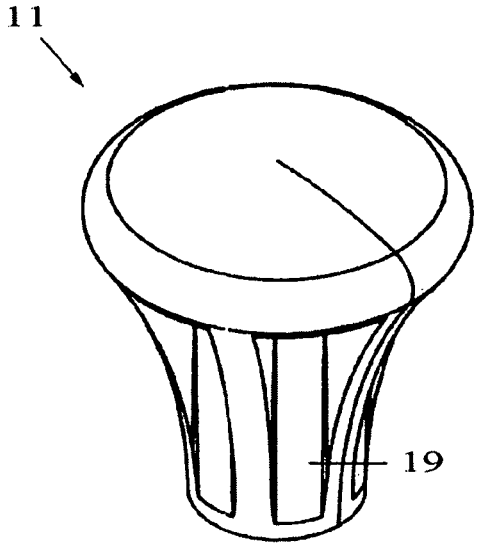
FIGS. 12 and 13 are perspective and cross-sectional views, respectively of the knob 11.
Figure 13:
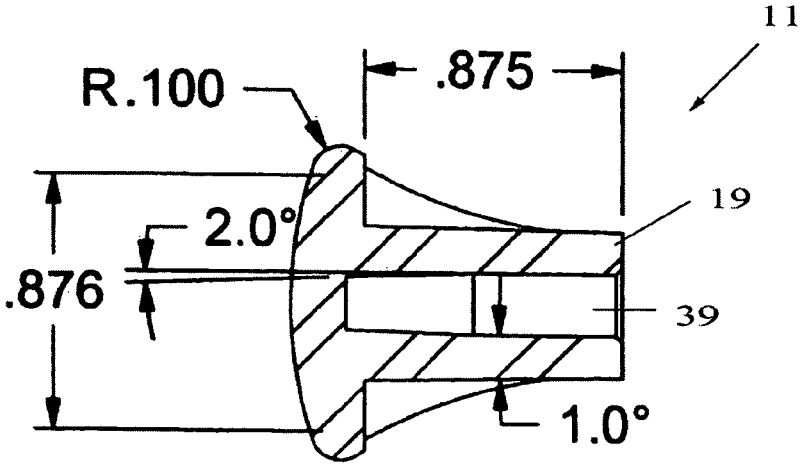

FIGS. 12 and 13 are perspective and cross-sectional views, respectively of the knob 11. The knob 11 may take various aesthetic design forms and generally comprises a rounded top connected to tapered body 19 to facilitate ease of grasping and turning. The radius of the top is approximately 0.1 inches. The length of the knob 11 may be 0.875 inches. The body 19 is defined by a tapped hole 39 running axially into the body 19 to receive the threaded post 16 of stem 12. The diameter of the tapped hole 39 conforms in diameter to the threaded stem 16, thereby allowing the stem 12 to remain securely connected within the hole 39.

Figure 14:
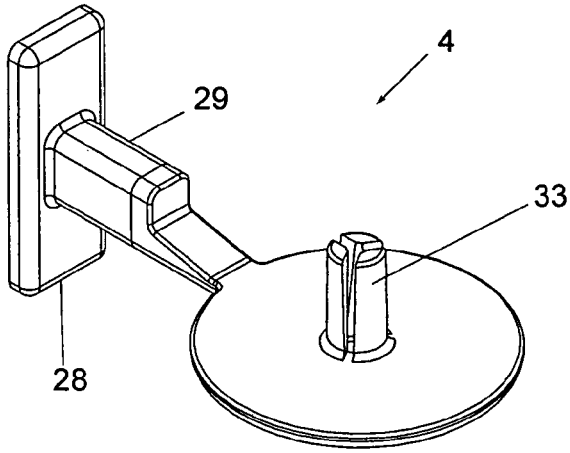
FIG. 14 is a perspective view of a wall-mount assembly 20 for supporting the rotary dispenser 2 on a wall.
Figure 15:
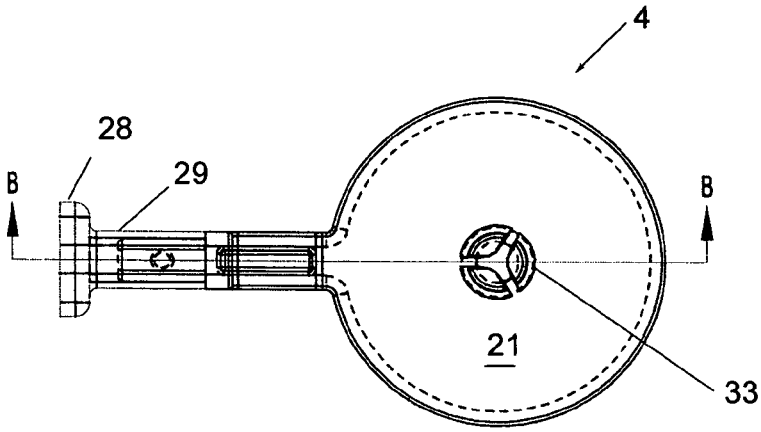
FIG. 15 is a top view of the wall-mount assembly 20 of FIG. 14.
Figure 16:
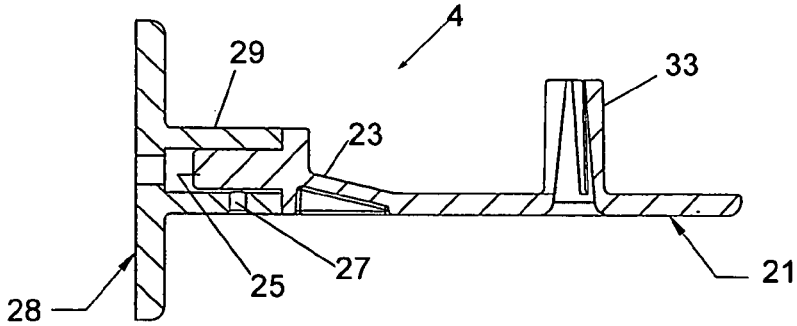
FIG. 16 is a side cross-section of the wall-mount assembly 20 of FIGS. 14-16.

FIGS. 14-16 are a perspective, top and side cross-section of the wall-mounted base unit 4 for supporting the rotary dispenser 2 on a wall. The vertical mounting bracket 28 is formed with a flat rear surface for adhesion by a screw, self-adhesive pad, hook-and-loop fabric, or any other suitable means to a wall. The vertical mounting bracket 28 may be molded as a generally rectangular member with a forwardly protruding block 29. In a screw-attachable embodiment, the block 29 is molded or bored with an axial through-bore 30 exiting rearwardly as seen in FIG. 16. This allows insertion of a screw into and through the forwardly protruding block 29 and rearwardly into the wall. The bracket 23 is formed with an extending cylindrical finger 25 for insertion into the axial through-bore 30 of block 29. Preferably, the extending cylindrical finger 25 and block 29 are provided with an inch or so of telescoping fit. This way, the bracket 23 may be adjusted more or less outwardly from the wall as desired and may be secured in position by set screw 27, which is inserted up through horizontal block 29 to engage the finger 25 of extension 23 for securement to the wall mounting bracket 28 and to prevent withdrawal.

The bracket 23 extends forwardly to the platform 21, which is preferably a cylindrical flat-topped member for rotatably seating the rotary dispenser 2. The platform 21 is formed with an upwardly protruding pivot 33 that is inserted up into the stem 12 of the rotary dispenser 2. The pivot 33 further includes three spring fingers independently molded to the platform 21 and collectively forming a circular cross-section. The spring fingers are spaced apart slightly but may be biased together for insertion of the rotary dispenser 2.

In use, the rotary dispenser 2 is seated atop the wall-mount base 4 by seating it on protruding pivot 33 atop the platform 21. The rotary spindle-type dispenser 2 remains free to revolve on platform 21, holding one or more electric toothbrushes plus standard toothbrushes 37 in a convenient, easily reachable, queued position. Again, spindle-type dispenser 2 is designed especially to accommodate the wide base of the electric toothbrush which houses internal batteries and internal mechanics.

Since the major components of the carousel 1 are molded acrylic or other plastic, they can be transparent or translucent, and especially well-suited for aesthetic lighting effects. In accordance with the present invention, such lighting effects are accomplished with an optional LED lighting module 40.

Figure 17:
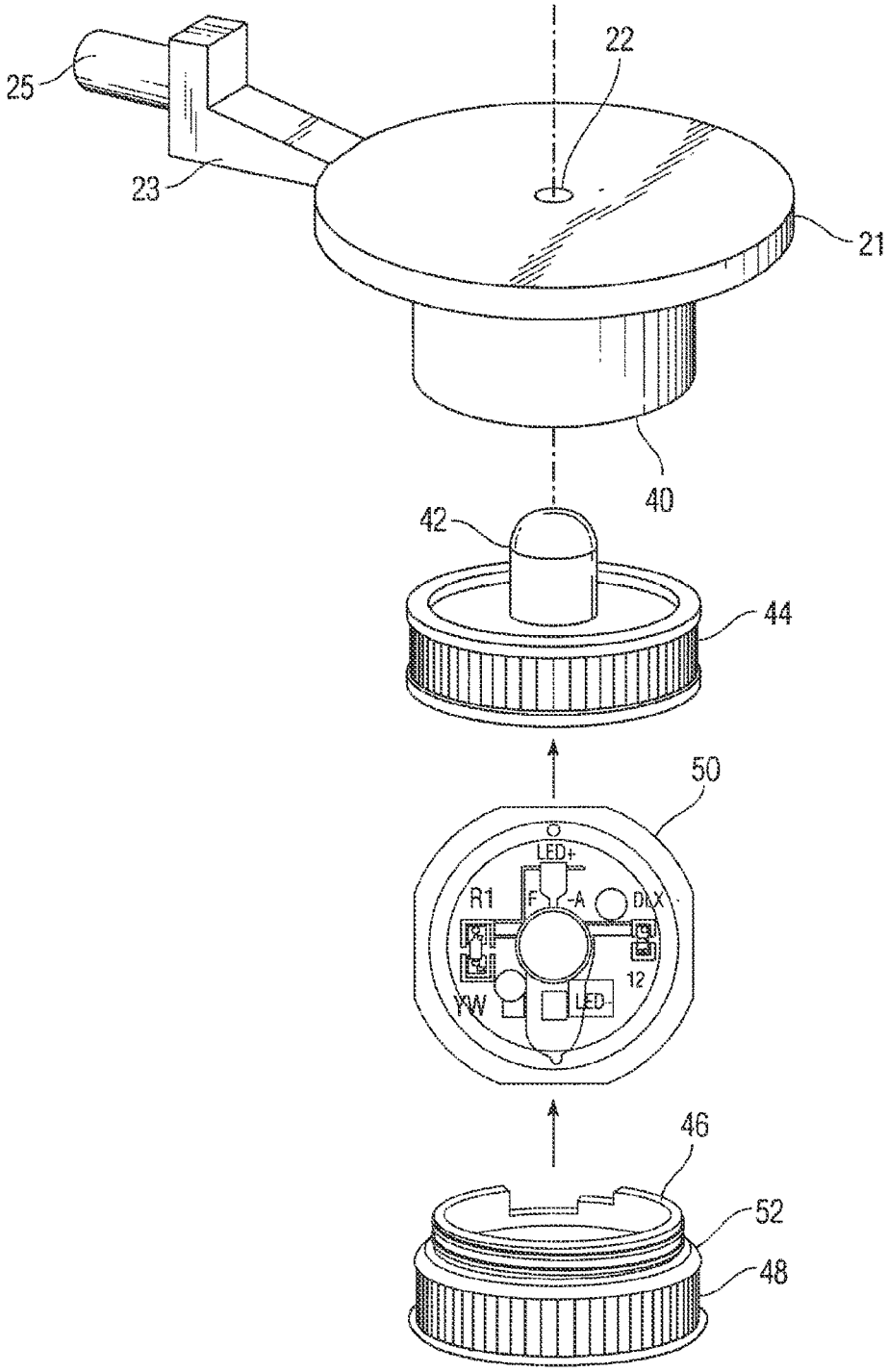
FIG. 17 is a perspective exploded view of the wall-mounted base unit 4 with LED lighting module 40 attached.

FIG. 17 is a perspective exploded view of the wall-mounted base unit 4 with LED lighting module 40 attached thereto. The LED lighting module 40 includes a two-piece plastic housing containing a battery and simple LED circuit board 50. The housing includes a top portion 44 with a centrally upwardly protruding dome 42. An LED is surface-mounted on the circuit board 50 and protrudes into the dome 42 to provide light. The housing includes a bottom portion 48 with screw threads 46 that screws into top portion 44, sealing there against with an O-ring 52. The LED lighting module 40 is adhered beneath the base unit 4, with the dome 42 protruding into then upwardly protruding pivot 33 of platform 21, which in turn extends into the stem 12 of the rotary dispenser 2. This configuration transmits the light efficiently up into and out from the sides of the clover disc 5, creating an aesthetically pleasing lighting effect and also generally serving as a night light. The circuit board 50 may include an on/off switch or a light sensor for automatic turn-on at night. For example, the Acolyte™ submersible FloraLyte™ is a suitable LED lighting module 40 with on/off switch and replaceable batteries (2×CR2032 batteries which last up to 50 hours with intermittent use).

In all the above-described embodiments, the carousel provides a practical solution that offer consumers a clean, conveniently placed storage solution for one or more bulky electric toothbrushes alone, or in combination with conventional manual toothbrushes, that facilitates more sanitary and convenient storage solution for a family of adults as well as children. The carousel has a highly attractive aesthetic appearance and provides intriguing queued rotational-access to the toothbrushes stored therein.

The dimensions of the carousel may be easily scaled in size to fit various toothbrush 37 dimensions. While relative dimensions and measurements set forth herein are important, the absolute dimensions are for illustrative purposes only and one skilled in the art will understand that the variations in size, shape, materials, form, use, assembly, and manner of operation are within the scope of the invention.

Having now fully set forth the preferred embodiments and certain modifications of the concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth herein.

We claim:

1. A universal toothbrush carousel comprising:

a rotary dispenser including a disc formed with a broken arcuate edge, a plurality of radially-spaced apertures through said disk, and a corresponding plurality of U-shaped recesses opening peripherally into the edge of said disc, said U-shaped recesses being uniformly and evenly interspaced between said apertures for holding electric toothbrushes captive therein, a knob mounted atop said disc, a concave circular base offset from said disc for collecting residue, wherein the bottom of said base is perforated to provide drainage for said residue, said concave base having a downwardly protruding circular lip for seating said base against a flat surface, and a stem attached centrally beneath said disc and extending to said concave base, said stem having a central hollow opening through said concave base; and a wall-mount assembly for mounting said rotary dispenser to a vertical wall, said wall-mount assembly comprising a circular platform for rotatably seating the rotary dispenser by the downwardly protruding circular lip of said concave base, a pivot including a plurality of concentric spring fingers protruding upwardly and centrally from said circular platform and collectively defining a circular cross-section wherein said spring fingers are biased together for insertion through said concave base into the central hollow opening of said stem, an extension protruding sidewardly from said platform, and a wall mounting bracket engagable with said extension, wherein said rotary dispenser revolves atop said circular platform upon turning of said knob to hold and dispense electric toothbrushes as well as standard toothbrushes in sequential rotary positions.

2. A toothbrush carousel according to claim 1, wherein said disc is formed with four radially-spaced apertures there through, and four shaped recesses opening outward from the sides of said disc.

3. A toothbrush carousel according to claim 2, wherein a radius of curvature of each U-shaped recess toward a center of said disc is approximately 0.313 inches.

4. A toothbrush carousel according to claim 2, wherein the apertures in said disc are circular with approximately one inch diameter.

* * * * *